US007451570B1

(12) United States Patent
Gavin

(10) Patent No.: US 7,451,570 B1
(45) Date of Patent: Nov. 18, 2008

(54) CASTING RISER PAN

(76) Inventor: Peter W. Gavin, 22 Pent Rd., Durham, CT (US) 06492

( * ) Notice: Subject to any disclaimer, the term of this patent is extended or adjusted under 35 U.S.C. 154(b) by 717 days.

(21) Appl. No.: 10/771,654

(22) Filed: Feb. 3, 2004

Related U.S. Application Data

(60) Provisional application No. 60/445,879, filed on Feb. 6, 2003.

(51) Int. Cl.
*E02D 29/14* (2006.01)

(52) U.S. Cl. ..... 52/20; 52/19; 52/21

(58) Field of Classification Search ..... 52/19, 52/20, 21, 742.14, 277; 404/25
See application file for complete search history.

(56) References Cited

U.S. PATENT DOCUMENTS 3,048,911 A 8/1962 Almon
3,346,230 A 10/1967 Tolf, Jr.
4,170,853 A 10/1979 Kohaut
5,123,776 A 6/1992 Lang et al.
5,617,679 A 4/1997 Meyers
5,711,536 A * 1/1998 Meyers ..... 277/606
5,852,901 A 12/1998 Meyers
6,088,972 A 7/2000 Johanneck
6,393,771 B1 * 5/2002 Stetson ..... 52/20
6,655,093 B1 12/2003 Gavin
6,688,072 B1 * 2/2004 Gavin ..... 52/742.14
6,773,202 B2 * 8/2004 Hagen ..... 404/25
2002/0166291 A1 11/2002 Campbell et al.
2003/0145527 A1 8/2003 Meyers

* cited by examiner

*Primary Examiner*—Richard E. Chilcot, Jr.
*Assistant Examiner*—Mark R Wendell

(57) ABSTRACT

A casting riser pan for defining an access opening in a cast concrete structure, serving as a cast for a cover for closing the access opening, and serving as a seat for the cover. The casting riser pan includes an orientation element for orienting the cover in case of out of round distortion of the casting riser pan and the concrete cover, an inner wall and an outer wall for increased radial strength, and a continuous securement element for attaching the casting riser pan to a casting mold for simultaneously casting the concrete structure and the cover.

45 Claims, 4 Drawing Sheets

CASTING RISER PAN

CROSS REFERENCE TO RELATED APPLICATIONS

This application claims priority from U.S. Provisional Application Ser. No. 60/445,879, filed on Feb. 6, 2003, entitled "Casting Riser Pan", the contents of which are herein incorporated by reference.

BACKGROUND OF THE INVENTION

1. Field of the Invention

The invention pertains to casting riser pans for defining access openings in concrete structures, and more specifically to a casting riser pan that defines an access opening through a cast concrete structure and serves as a casting mold and seat for a removable cover inserted into the casting riser pan for closing the access opening.

2. Description of the Prior Art

Components for defining access passageway openings in cast concrete structures such as septic tanks are known in the art. An example is U.S. Pat. No. 6,484,451 entitled "Stackable Riser Resistant to Soil Movement" to Gavin, the contents of which are herein incorporated by reference, which provides for a stackable riser component that may be cast into the lid of a concrete structure for forming an access opening. Gavin also discloses stacking additional risers to form an access passageway. It is desirable to provide a cover for the access opening or passageway, and to provide a seat for supporting the cover in the access passageway. Existing covers are injection-molded or cast in concrete or other heavy material. Existing covers are cast using a removable steel pan placed in a riser cast into the lid of a concrete structure, and a concrete ring is also cast into the riser to serve as a seat for the cover.

Integrated riser and pan component for casting a cover and serving as a seat for the cover are also known in the art. U.S. Patent Application Publication No. 2003/0145527 to Meyers discloses one such riser pan. The riser pan disclosed in Meyers includes a single, frustoconical wall for casting a frustoconical cover. Riser pans such as the one disclosed in Meyers are rested on a flat surface and concrete is poured into the pan component to form the cover. A plastic handle is inserted into the concrete before the cover hardens. After the cover is made, the riser pan is placed on top of a structure casting mold and the concrete cover is placed in the riser pan for weight. Then concrete is poured around the riser pan to make the concrete structure. This process requires multiple steps, which is undesirable.

Pans may deform during the casting process. A cover as described above may seat incorrectly unless the cover is correctly aligned to match the deformation. Existing pans and riser pans such as Meyers lack mechanisms for ensuring alignment of the pan and cover. Single-walled riser pans as known in the art are especially susceptible to deformation during the casting process and are subject to weight from loads stacked on the riser pan, such as stackable riser systems, or weight from street-level objects over the riser system.

Therefore a need exists for a casting riser pan that attaches to a casting mold to define an access opening in a concrete structure and allows a cover to be cast simultaneously with the concrete structure while orienting the cover to provide effective seating, and providing support to minimize deformation of the casting riser pan and to support loads placed on the riser pan.

SUMMARY OF SEVERAL EMBODIMENTS OF THE INVENTION

A casting riser pan in accordance with the present invention addresses these shortcomings. A casting riser pan in accordance with the present invention attaches to a casting mold for a concrete structure such as a concrete septic tank and defines an access opening in the wall of the structure. The casting riser pan also defines a seat for a cover or other closure for the access opening and acts as a mold for the cover, which can be cast simultaneously with the concrete structure itself. The casting riser pan includes an orientation element for orienting the cover in the casting riser pan after casting. Another embodiment of the invention includes an outer wall for defining a void containing concrete for providing vertical and horizontal support to the casting riser pan.

BRIEF DESCRIPTION OF THE DRAWINGS

In order that the invention be more fully comprehended, it will now be described, by way of example, with reference to the accompanying drawings, in which.

DESCRIPTION OF EMBODIMENTS OF THE INVENTION

Figure 1:
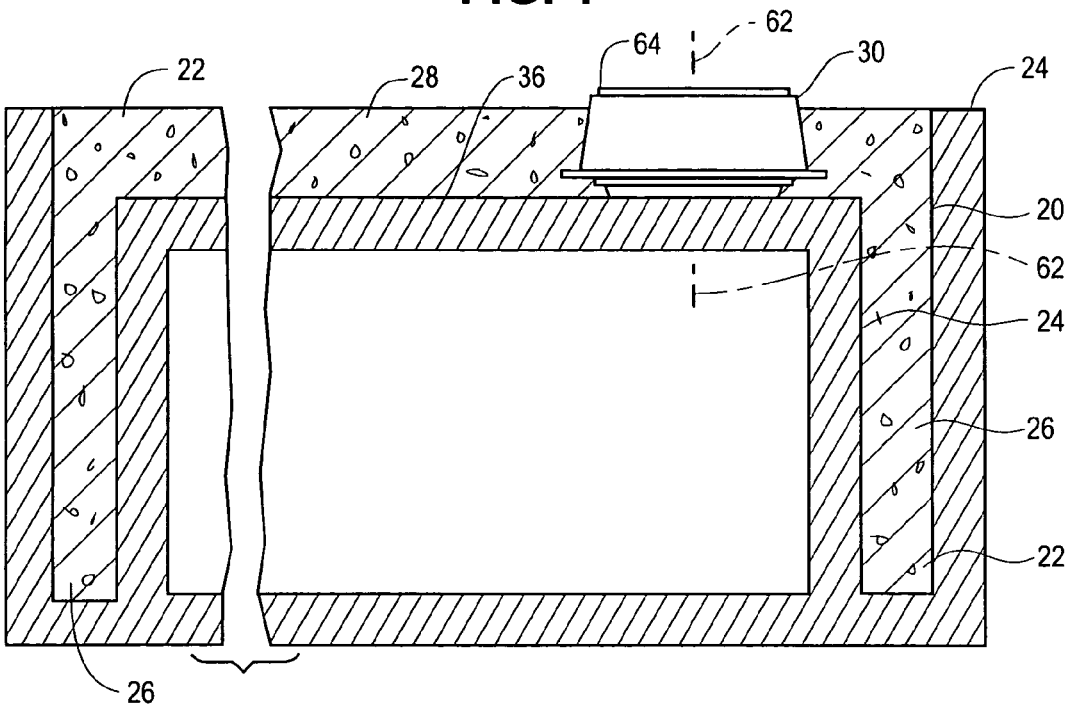
FIG. 1 is a cross section schematic view of a casting riser pan of the invention molded into the top of a concrete structure.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation. Like elements in the drawings have the same numbers.

FIG. 1 shows a concrete structure 20 in which a casting riser pan 30 in accordance with the present invention is embedded in the top wall 28, typically a lid, of the concrete structure 20 to form an access opening to allow entry of personnel and/or material into the concrete structure 20. In the embodiment shown in FIG. 1, the concrete structure 20 is a concrete septic tank, although the casting riser pan of the present invention can be used in any molded concrete structure in which an access opening is desirable. Although the embodiments described herein are shown in the context of an access opening and casting riser pan on the top wall of the concrete structure, it would also be known to one skilled in the art to place access openings on other walls of the concrete structure. Spatial orientation terms such as "top" and "bottom" are used herein as if the side containing the access opening and casting riser pan is the top of the structure, i.e., the lower portion of the casting riser pan defines the access opening of the interior portion of the concrete structure, and the top portion of the casting riser pan defines the access opening of the exterior of the concrete structure.

In FIG. 1, concrete structure 20 is molded by pouring concrete 22 over casting mold 24 so that sides 26 and top 28 of the concrete structure 20 are formed. Casting mold 24 may be any casting mold known in the art, including steel and wooden casting molds. The concrete 22 is poured around casting riser pan 30 so that the riser pan 30 is cast into the top 28 of the concrete structure 20. It should be understood that "concrete" is used as a general term and is defined herein to include cement, and cement-bound mixtures. Casting riser pan 30 which is attached to top 36 of casting mold 24 defines an access opening through top 28 of the concrete structure, into the concrete structure, when the concrete structure is removed from casting mold 24. The access opening is formed around vertical axis 62. FIG. 1 shows an embodiment of the casting riser pan 30 of the present invention having a generally cylindrical sidewall, although one skilled in the art would know that aspects of the present invention could be practiced with other constructions, such as rectangular or other non-cylindrical casting riser pans for forming non-circular access openings. Preferably casting riser pan 30 is one piece molded plastic. One suitable plastic is high-density polyethylene ("HPDE").

FIGS. 2-10 further illustrate embodiments of the casting riser pan 30 shown in FIG. 1.

Figure 2:
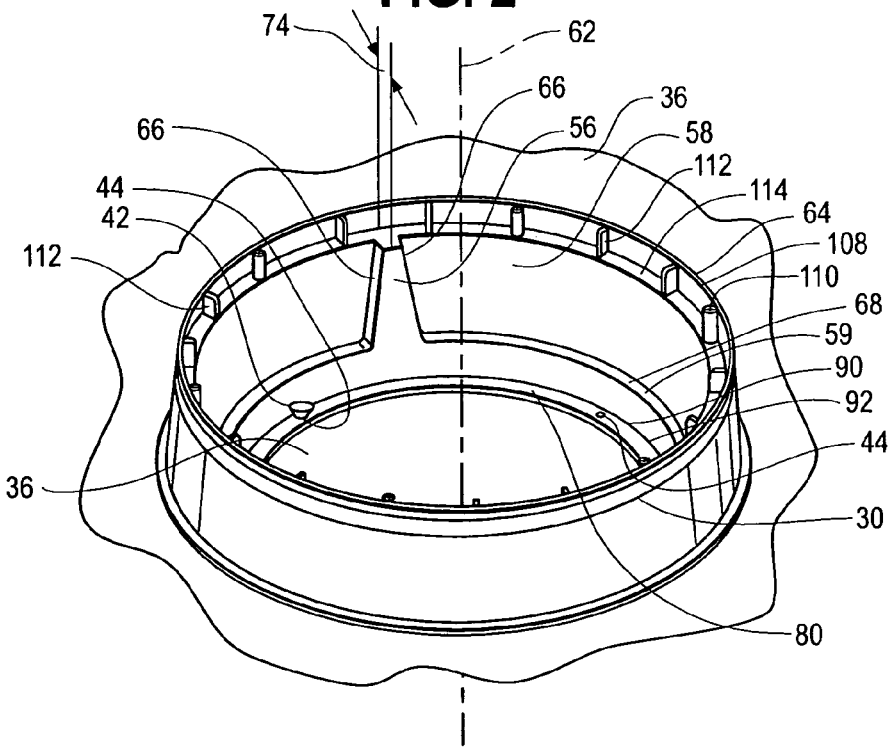
FIG. 2 is a front perspective view of the casting riser pan of FIG. 1 mounted on the top of the mold before the concrete is added to the mold and riser.

FIG. 2 shows the casting riser pan 30 shown in FIG. 1 temporarily fastened to the top 36 of the casting mold 24 by pins 42 before concrete 22 is poured. Inner wall 58 is preferably annular and tapered radially outward from axis 62, along a distance axially upward from bottom portion 82 toward the top portion 84, so that the diameter of the bottom portion 82 of inner wall 58 is smaller than the diameter of the top portion 84 of inner wall 58. The top portion 84 of inner wall 58 also preferably includes substantially transverse axially facing shoulder 114. The inner surface of inner wall 58 also has an upper portion and a lower portion having between them a substantially transverse, axially facing shoulder 68 extending radially inward from the inner surface of inner wall 58, including transverse seal face 59. Inner wall 58 also has an orientation element 56 for orienting a cover, as described below. In the embodiment shown in FIG. 2, orientation element 56 is a protrusion extending radially inward from the inner surface of inner wall 58 toward axis 62. Orientation element 56 tapers 66 along an axial distance from shoulder 68 toward top portion 84, having a smaller width and smaller inward radial height 74 at the top of orientation element 56. In other embodiments of the present invention, orientation element 56 could be a recess extending radially outward from the inner surface of inner wall 58, tapering along an axial distance from top portion 84 to shoulder 68 and having a smaller width at the bottom of orientation element 56.

The casting riser pan 30 has a continuous securement element 80 for securing casting riser pan 30 to casting mold 24. Continuous securement element 80 is a continuous radial lip connected to bottom portion 82 of inner wall 58 at weakened annular ring or groove 92. Continuous securement element 80 is separable from bottom portion 82 of inner wall 58 at weakened ring 92 when concrete structure 20 (not shown) is removed from casting mold 24, as described below. Continuous securement element 80 has attachment holes 44 for inserting pins, 42. One of the pins, 42, is shown inserted through attachment hole 44 and into top 36. Pins 42 are preferably made of reinforced plastic and are preferably wedge-shaped in cross section. Attachment devices for fastening continuous securement element 80 to casting mold 24 other than pins 42 would be known to one skilled in the art, such as bolts, screws, nails or adhesives.

Outer wall 78 is preferably annular and angles radially outward from axis 62 along a distance axially downward from top portion 84 of inner wall 58. The embodiment shown in FIG. 2 includes an anchor element extending radially outward from outer wall 78.

Upstanding wall 108 extends axially upward from shoulder 114 to top portion 64 for connection to a stackable riser system, as described below. The top portion 64 of the upstanding wall 108 represents the axial end of casting riser pan 30. In the embodiment of the invention shown in FIG. 2, top portion 64 of upstanding wall 108 is tapered. In alternative embodiments, top portion 64 of upstanding wall 108 is straight. Substantially vertical ribs 112 extend between shoulder 114 and upstanding wall 108 for reinforcement. Substantially vertical bosses define fastener holes 110 for connecting a stackable riser, as described below.

Figure 3:
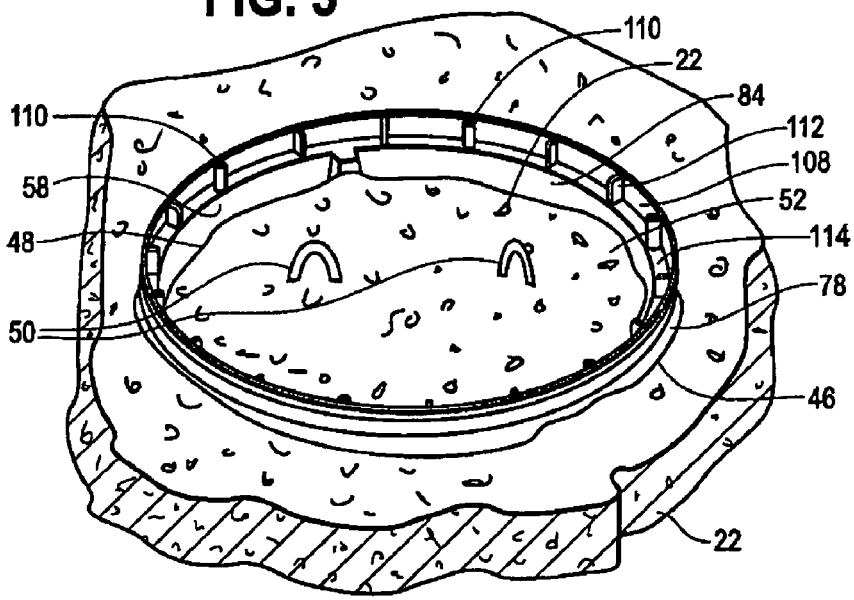
FIG. 3 is a front perspective view of the casting riser pan of FIG. 2, cast into the top of the concrete structure, and containing a cast concrete cover.

FIG. 3 shows the casting riser pan 30 of FIG. 2 embedded in the concrete 22 of concrete structure 20. Concrete 22 is poured around casting riser pan 30 to height 46. Casting riser pan 30 allows simultaneous casting of the concrete structure 20 and concrete cover 52. The concrete is poured into the casting riser pan 30 to height 48, forming removable concrete cover 52. Loops 50 are placed into cover 52 to act as handles. Loops 50 can be inserted into cover 52 before the concrete hardens, or in an alternative embodiment are attached to top 36 of casting mold 24 with pins (not shown) prior to pouring the concrete 22. Anchor element 79 (see FIG. 5) of outer wall 78 extends radially outward into concrete 22.

Figure 5:
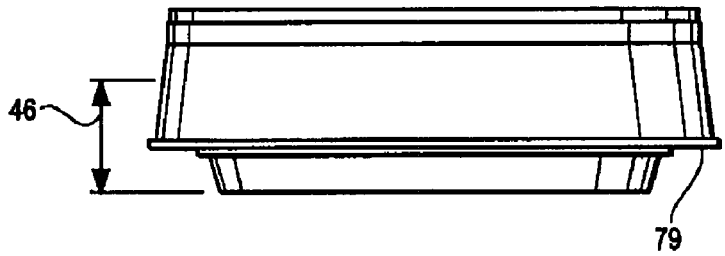
FIG. 5 is a front view of the casting riser pan of FIG. 2.
Figure 4:
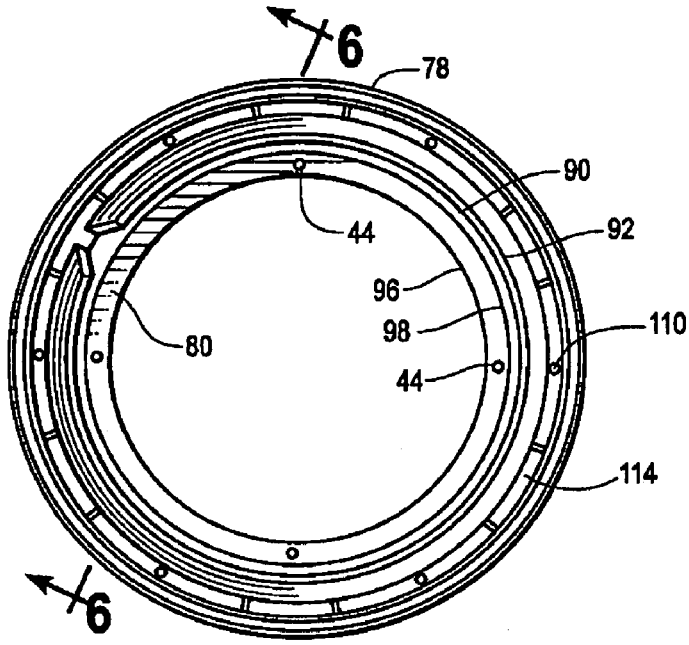
FIG. 4 is a top view of the casting riser pan of FIG. 2.
Figure 6:
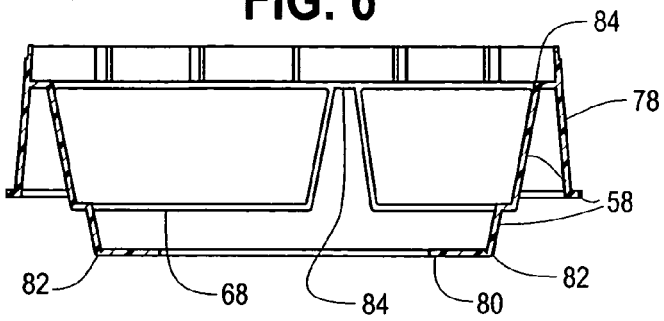
FIG. 6 is a cross section view of the casting riser pan of FIG. 4 taken along 6-6.

FIG. 4 is a top view of the casting riser pan 30 of FIG. 2. FIG. 5 is a front view of the casting riser pan 30 of FIG. 2 showing anchor element 79 and height 46 of concrete 22. FIG. 6 is a sectional view of the casting riser pan 30 of FIG. 4 taken along section line 6-6, illustrating orientation element 56 tapering from shoulder 68 to top portion 84 of inner wall 58.

Figure 7:
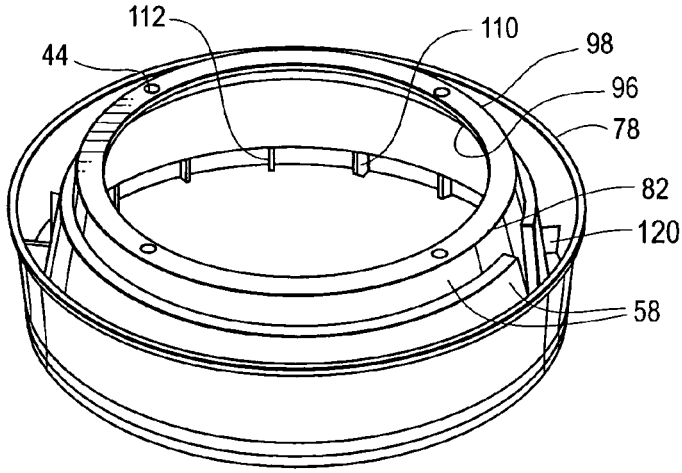
FIG. 7 is a bottom perspective view of the casting riser pan of FIG. 2.

FIG. 7 is a bottom perspective view of an alternative embodiment of the casting riser pan 30 of FIG. 2. Radial gussets 120 extend between inner wall 58 and outer wall 78.

Figure 8:
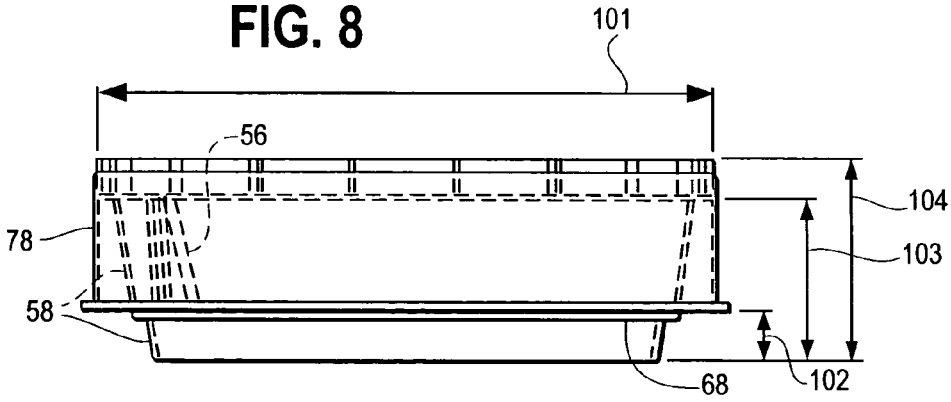
FIG. 8 is a cross section schematic view of the casting riser pan of FIG. 2.

FIG. 8 shows the preferred dimensions in inches of the embodiment of the casting riser pan 30 shown in FIG. 2, although one skilled in the art would know to make a casting riser pan embodying the present invention with other dimensions. Diameter 101 is 22.633", height 102 from bottom portion 82 of inner wall 58 to anchor element of outer wall 78 is 1.72", height 103 from bottom portion 82 to top portion 84 of inner wall 58 is 6.000" and height 104 from bottom portion 82 of inner wall 58 to top portion 64 of upstanding wall 108 is 7.240 inches.

Figure 9:
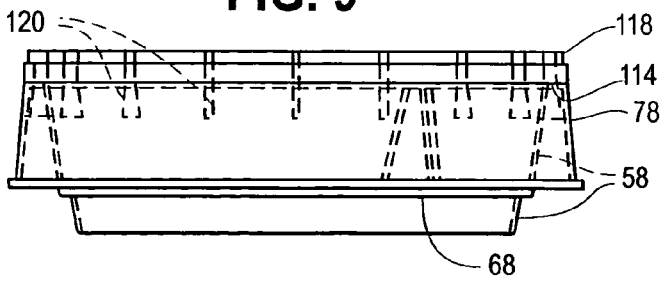
FIG. 9 is a cross section schematic view of another casting riser pan of the invention.

FIG. 9 shows a cross section of an alternative embodiment of the casting riser pan 30 shown in FIG. 2. Radial gussets 120 extending between inner wall 58 and outer wall 78 preferably extend to the underside of shoulder 114.

Figure 10:
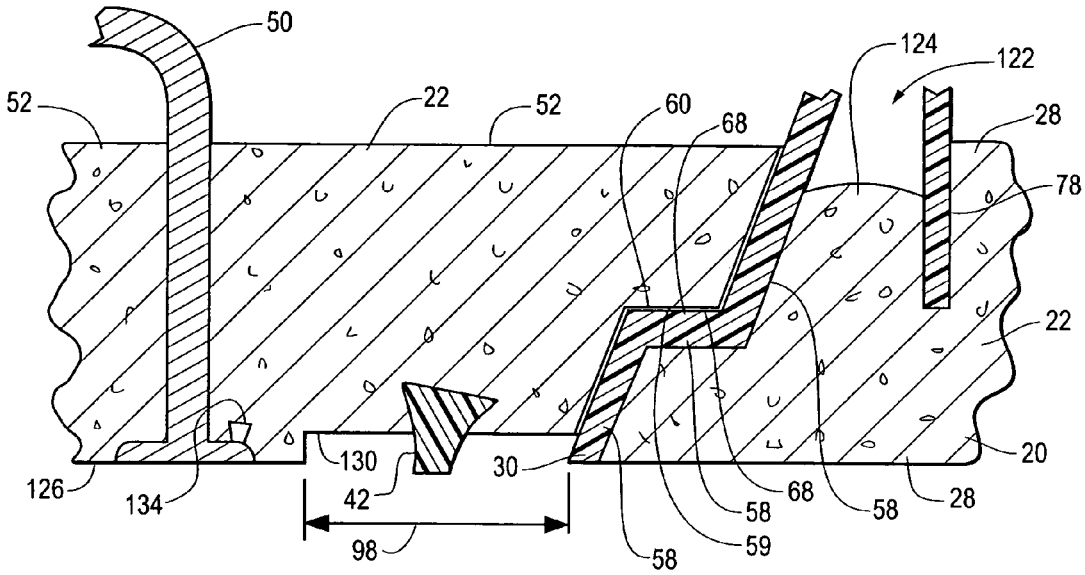
FIG. 10 is a perspective schematic section view of a cover formed by the casting riser pan of FIG. 3.

FIG. 10 shows a cross section of an embodiment of the casting riser pan 30 of FIGS. 2 and 3 after concrete 22 has been formed into concrete structure 20. Casting riser pan 30 is embedded in top wall 28 of concrete structure 20. Concrete 22 of top wall 28 surrounds casting riser pan 30 and extends into space 122 between inner wall 58 and outer wall 78, forming a reinforcing truncated concrete gusset 124. Gusset 124 may extend in a continuous ring around axis 62. The embodiment shown in FIG. 10 shows an outer wall 78 without an anchor element. Cover 52 includes shoulder 55 that rests on shoulder 68 of inner wall 58, providing seal faces 59 and 60 between cover 52 and inner wall 58. In the embodiment shown in FIG. 10, casting mold 24 has been removed after concrete structure 20 has hardened. Continuous securement element 80 (not shown) attached to top 36 of casting mold 24 (not shown) has been removed from inner wall 58 at weakened annular ring 92, leaving annular depression 130 in cover 52 formed by continuous securement element 80. Annular depression 130 has the width 98 of continuous securement element 80. A portion of pin 42 remains in cover 52. Pin 42 is preferably broken away below the bottom 126 of the cover 52 after removal of the newly molded cover 52 from top 36 of the concrete structure 20.

Loop 50 is shown molded into cover 52 to act as a handle. In the embodiment shown in FIG. 10, loop 50 was attached to top 36 of casting mold 24 with pin 134 prior to pouring concrete 22. A portion of pin 134 remains embedded in the concrete of cover 52 after the concrete structure 20 is removed from the casting mold 24.

Figure 11:
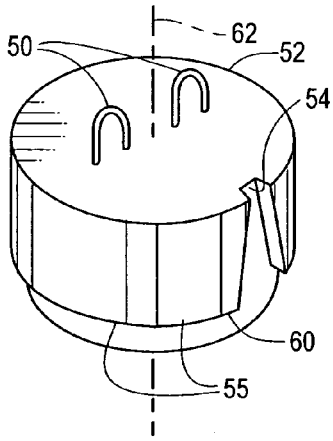
FIG. 11 is a perspective view of the cover of FIG. 3.

FIG. 11 is a perspective view of the cover 52 of FIG. 3. Cover 52 includes an orientation element 54 and shoulder 55 corresponding to the orientation element 56 and shoulder 68 of casting riser pan 30 (not shown). In the embodiment of the invention shown in FIG. 11, orientation element 54 is a groove corresponding to a casting riser pan having a protrusion as an orientation element, and orients cover 52 around axis 62.

Figure 12:
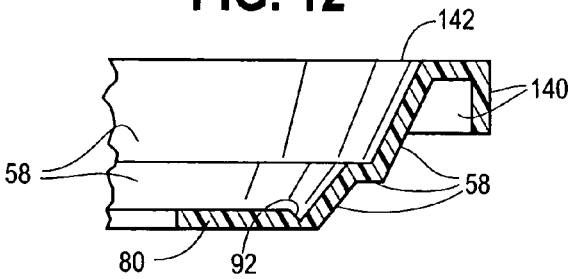
FIG. 12 is a cross section of another embodiment of a riser pan in accordance with the present invention.

FIG. 12 shows a cross section of an alternative embodiment of the casting riser pan of the present invention. Casting riser pan 142 has a tapered inner wall 58 and substantially vertical outer wall 140. Continuous securement element 80 is attached to inner wall 58 at weakened ring 92.

Figure 13:
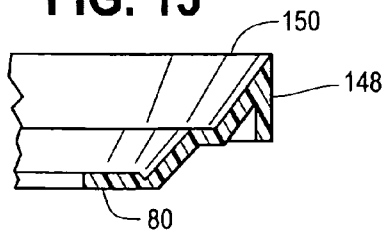
FIG. 13 is a cross section of another embodiment of a riser pan in accordance with the present invention.

FIG. 13 shows a cross section of an alternative embodiment of the casting riser pan of the present invention. Casting riser pan 150 has a tapered inner wall and a substantially vertical outer wall 148.

Referring to FIGS. 1-11, the casting riser pan 30 described above is used to define an access opening in concrete structure 20 and serves as a mold for casting a concrete cover 52 for closing the access opening in concrete structure 20. Casting riser pan 30 also acts as a seat for cover 52 after casting. Casting riser pan 30 is attached to the top 36 of casting mold 24 by continuous securement element 80 before concrete 22 is poured. Pins 42 through attachment holes 44 in continuous securement element 80 prevent vertical and horizontal movement of the casting riser pan 30 under force of the liquid concrete. Loops 50 are used to create handles in cover 52. Loops 50 are either attached to casting mold 24 using pins 134 prior to pouring the concrete, or inserted into cover 52 before the concrete hardens.

Concrete cover 52 is cast simultaneously with concrete structure 20 by pouring concrete 22 around and into casting riser pan 30. The inner surface of inner wall 58 of casting riser pan 30 defines the side walls of cover 52, and the top 36 of casting mold 24 defines the bottom surface of cover 52. Inner wall 58 is tapered axially inward from top portion 84 to bottom portion 82. This provides additional radial strength against the inward force of the concrete, eases axial removal and insertion of cover 52 into the casting riser pan 30, and prevents concrete cover 52 from falling through the access opening into the interior of the concrete structure 20. When cover 52 is cast, shoulder 68 of inner wall 58, having seal face 59, defines corresponding shoulder 55 in cover 52 having seal face 60. Shoulder 55 of cover 52 rests on shoulder 68 of inner wall 58 so that seal face 60 contacts seal face 59. This prevents wedging of the cover under its weight against tapered inner wall 58. The height of shoulder 68 also sets the height of the cover 52 within inner wall 58 so that shoulder 55 in contact with shoulder 68 prevents radial binding of the cover to inner wall 58 when the cover is inserted into casting riser pan 30 in contact with inner wall 58. The horizontal seal between seal face 59 of inner wall 58 and seal face 60 of concrete cover 52 prevents leakage between the concrete cover 52 and inner wall 58 that could occur in the presence of radial distortion between concrete cover 52 and inner wall 58 above and below seal faces 59, 60. One skilled in the art would know other embodiments, including embodiments with inner wall 58 tapered without shoulder 68, and inner wall untapered but including shoulder 68, allowing cover 52 to rest on seal face 59.

When concrete is poured around and into the casting riser pan 30, inner wall 58 may distort out of round slightly, forming the cover 52 with the same out of round distortion. Orientation element 56 orients the cover 52 when the cover is replaced in the casting riser pan 30 so that the cover 52 is positioned within the casting riser pan 30 with the same angular orientation around axis 62 as the cover 52 was molded by the casting riser pan so that the cover does not bind against inner wall 58 after distortion. During the casting process, orientation element 56 of inner wall 58 forms a corresponding orientation element 54 in cover 52. In embodiments described above where orientation element 56 is a protrusion extending radially inward from inner wall 58 and tapering to a smaller width at the top of orientation element, corresponding orientation element 54 of cover 52 is a groove or recess tapering to a smaller width at bottom of orientation element 54. Tapered orientation element 56 releases concrete cover 52 without binding against the cover 52 when the cover 52 is drawn upward axially from the casting riser pan 30. In the alternative embodiments discussed above where orientation element 56 is a recess extending radially outward from inner wall 58 and tapering to a smaller width at bottom of orientation element 56, recessed orientation element 56 forms a corresponding orientation element 54 as a protrusion extending outward from cover 52 tapering to a smaller width at bottom of orientation element 54 to allow cover 52 to be drawn upward without binding.

In the double-walled casting riser pan embodiment shown in FIGS. 2-10, concrete 22 of the top wall 28 of concrete structure surrounds casting riser pan 30 and extends into space 122 between inner wall 58 and outer wall 78, forming reinforcement wedge 124 between the angled-apart walls. In the generally cylindrical embodiment shown, reinforcement wedge 124 may extend in a continuous ring around axis 62. Reinforcement wedge 124 is defined by the outer surface of inner wall 58 and the inner surface of outer wall 78. Reinforcement wedge 124 provides reinforcement for weight from loads stacked on the riser pan, such as stackable riser systems, or weight from street-level objects over the riser system. Referring to FIGS. 7 and 9, another embodiment of the invention shows radial gussets 120 extending from the outer surface of inner wall 58 to the inner surface of outer wall 78 to provide additional radial reinforcement between inner wall 58 and outer wall 78 during the casting process.

Minimum opening dimension into a concrete structure such as a septic tank is often specified by a municipality. Because continuous securement element 80 is separable from casting riser pan 30, casting riser pan 30 has a smaller axial opening diameter through the riser pan before the riser pan is cast in a concrete container wall than the minimum diameter of the axial opening into the container through the casting riser pan provided by the casting riser pan after the casting riser pan is cast in the wall 28 of concrete structure 20. According to the invention, a riser pan of the invention having a tapered inner wall and an opening diameter that is smaller than the specified minimum can be attached to the mold, cast in the mold, and then have the continuous securement element 80 removed to meet or exceed minimum opening dimension.

After the concrete structure 20 and cover 52 are cast, concrete structure 20 is removed from casting mold 24. The continuous securement element 80 has a weakened cross section to allow continuous securement element 80 to be separated from casting riser pan 30 when the concrete structure 20 is removed from casting mold 24. In the embodiment shown in FIG. 2, the weakened cross section is an annular ring or groove 92 in continuous securement element 80. Preferably, pins 42 are made of plastic or other frangible material. Pin 42, which is cast into the cover, is withdrawn from top 36 of the casting mold 24 when the newly molded cover is removed from casting riser pan 30 and from top 36 of the tank. Pin 42 is preferably broken away below the bottom 126 of the cover after removal of the newly molded cover from top 36 of the casting mold. Pins 42 can be removed before, during or after continuous securement element 80 is removed from casting riser pan 30.

Where the concrete structure 20 is designed to be placed below grade level, a casting riser pan in accordance with the present invention may be used with a stackable riser system as described in Gavin. Referring to FIGS. 2-10, a stackable riser as described in Gavin may be mounted on axially extending upstanding wall 108 which is reinforced by ribs 112 extending axially from ledge 114. The stackable riser is fastened to casting riser pan 30 by fasteners such as screws inserted into fastener holes 110. In the embodiment of the invention shown in FIG. 2, top portion 64 of upstanding wall 108 is tapered to mate with a stackable riser having a correspondingly tapered channel. In alternative embodiments, top portion 64 of upstanding wall 108 may be straight and mate with a stackable riser having a plurality of slots for ribs 112. One skilled in the art would know how to adapt the present invention to other stackable riser systems.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention.

What is claimed is:

1. A casting riser pan comprising:

a wall having a top portion, a bottom portion, and an orientation element;

said wall defining an opening having an axis therethrough and substantially normal thereto, said wall generally corresponding to the periphery of a removable concrete cover having an orientation element generally corresponding to and configured to mate with said orientation element of said wall to facilitate seating of said cover in said casting riser pan in a predetermined angular orientation about said axis with respect to the angular orientation of said casting riser pan about said axis.

2. A casting riser pan as claimed in claim 1, wherein said wall is generally annular.

3. A casting riser pan as claimed in claim 1, wherein said wall is tapered radially outward from said bottom portion to said top portion.

4. A casting riser pan as claimed in claim 1, wherein said wall further includes an upper portion and a lower portion and a transverse shoulder extending radially inward between said upper portion and said lower portion.

5. A casting riser pan as claimed in claim 3, wherein said wall further includes an upper portion and a lower portion and a transverse shoulder extending radially inward between said upper portion and said lower portion.

6. A casting riser pan as claimed in claim 1, wherein said orientation element of said wall comprises a protrusion extending radially inward and said orientation element of said concrete cover comprises a recess in the concrete cover.

7. A casting riser pan as claimed in claim 6, wherein said protrusion has a top portion and a bottom portion, said top portion of said protrusion being narrower than said bottom portion of said protrusion.

8. A casting riser pan as claimed in claim 1, wherein said orientation element of said wall comprises an indentation in said wall and said orientation element of said concrete cover comprises a protrusion from the concrete cover.

9. A casting riser pan as claimed in claim 8, wherein said indentation has a top portion and a bottom portion, said top portion of said indentation being wider than said bottom portion of said indentation.

10. A casting riser pan as claimed in claim 1, further comprising a continuous securement element extending radially inward from said bottom portion of said wall, said continuous securement element adapted to be connected to a casting mold.

11. A casting riser pan as claimed in claim 10, wherein said continuous securement element further includes a weakened region connecting said continuous securement element to said bottom edge portion.

12. A casting riser pan as claimed in claim 10, wherein said continuous securement element further includes one or more attachment holes adapted to receive a fastener for securing said continuous securement element to the casting mold.

13. The combination of a casting riser pan as claimed in claim 12 and at least one fastener inserted through one of said attachment holes and adapted to be attached to the casting mold, said fastener having a head portion with a diameter generally larger than the diameter of said attachment holes and a shaft portion having a diameter generally smaller than the diameter of said holes.

14. A casting riser pan as claimed in claim 1, further comprising an end portion adapted to be received by a stackable riser section.

15. A casting riser pan as claimed in claim 14, wherein said end portion includes an axially extending upstanding wall.

16. The combination of the casting riser pan as claimed in claim 14 and a stackable riser.

17. The combination of the casting riser pan as claimed in claim 1 and a concrete cover.

18. A casting riser pan comprising:

an inner wall having an top portion, a bottom portion, and an orientation element;

an outer wall;

said inner wall defining an opening having an axis therethrough and substantially normal thereto, said inner wall generally corresponding to the periphery of a removable concrete cover having an orientation element generally corresponding to and configured to mate with said orientation element of said inner wall to facilitate seating of said concrete cover in said casting riser pan in a predetermined angular orientation about said axis with respect to the angular orientation of said casting riser pan about said axis.

19. A casting riser pan as claimed in claim 18, wherein said outer wall extends angularly outward from said inner wall.

20. A casting riser pan as claimed in claim 18, wherein said inner wall is generally annular.

21. A casting riser pan as claimed in claim 18, wherein said outer wall is generally annular.

22. A casting riser pan as claimed in claim 18, wherein said inner wall is tapered radially outward from said bottom portion to said top portion.

23. A casting riser pan as claimed in claim 18, wherein said inner wall further includes an upper portion and a lower portion and a transverse shoulder extending radially inward between said upper portion and said lower portion.

24. A casting riser pan as claimed in claim 22, wherein said inner wall further includes an upper portion and a lower portion and a transverse shoulder extending radially inward between said upper portion and said lower portion.

25. A casting riser pan as claimed in claim 18, wherein said top portion of said inner wall further comprises a substantially transverse shoulder extending radially outward from said inner wall, said outer wall connected to said inner wall at said substantially transverse shoulder.

26. A casting riser pan as claimed in claim 18, wherein said orientation element of said inner wall comprises a protrusion extending radially inward and said orientation element of said concrete cover comprises a recess in the concrete cover.

27. A casting riser pan as claimed in claim 26, wherein said protrusion has a top portion and a bottom portion, said top portion of said protrusion being narrower than said bottom portion of said protrusion.

28. A casting riser pan as claimed in claim 18, wherein said orientation element of said inner wall comprises an indentation in said inner wall and said orientation element of said concrete cover comprises a protrusion from the concrete cover.

29. A casting riser pan as claimed in claim 28, wherein said indentation has a top portion and a bottom portion, said top portion of said indentation being wider than said bottom portion of said indentation.

30. A casting riser pan as claimed in claim 18, further comprising a continuous securement element extending radially inward from said bottom portion of said inner wall, said continuous securement element adapted to be connected to a casting mold.

31. A casting riser pan as claimed in claim 30, wherein said continuous securement element further includes a weakened region connecting said continuous securement element to said bottom edge portion.

32. A casting riser pan as claimed in claim 30, wherein said continuous securement element further includes one or more holes adapted to receive a fastener for securing said continuous securement element to the casting mold.

33. The combination of a casting riser pan as claimed in claim 32 and at least one fastener inserted through one of said attachment holes and adapted to be attached to the casting mold, said fastener having a head portion with a diameter generally larger than the diameter of said attachment holes and a shaft portion having a diameter generally smaller than the diameter of said holes.

34. A casting riser pan as claimed in claim 18, further comprising an anchor element extending radially outward from said outer wall, said anchor element adapted to be embedded in the concrete wall.

35. A casting riser pan as claimed in claim 33, wherein said anchor element is generally annular.

36. A casting riser pan as claimed in claim 18, further comprising a plurality of ribs connected to said outer wall and said inner wall.

37. A casting riser pan as claimed in claim 18, further comprising an end portion adapted to be received by a stackable riser section.

38. A casting riser pan as claimed in claim 37, wherein said end portion includes an axially extending upstanding wall.

39. The combination of the casting riser pan as claimed in claim 37 and a stackable riser.

40. The combination of the casting riser pan as claimed in claim 18 and a concrete cover.

41. The casting riser pan as claimed in claim 1 in combination with a concrete structure into which said casting riser pan is integrated.

42. The casting riser pan as claimed in claim 1 in combination with said concrete cover and a concrete structure into which said casting riser pan is integrated.

43. The casting riser pan as claimed in claim 18 in combination with a concrete structure into which said casting riser pan is integrated.

44. The casting riser pan as claimed in claim 18 in combination with said concrete cover and a concrete structure into which said casting riser pan is integrated.

45. A method for forming an opening in a cast concrete structure and a concrete cover keyed to the opening, comprising the steps of:

placing a casting riser pan as claimed in claim 1 into a form;

placing concrete into said form outside said wall of said casting riser pan; and placing concrete into said form within said wall of said casting riser pan.

* * * * *